US006168033B1

(12) United States Patent
Wilkins

(10) Patent No.: US 6,168,033 B1
(45) Date of Patent: Jan. 2, 2001

(54) CARTON BOX RETAINER

(76) Inventor: Andre Philip Wilkins, "The Walled Garden", Loughborough Road, Bunny, Nottinghamshire NG1 16 QT (GB)

( * ) Notice: Under 35 U.S.C. 154(b), the term of this patent shall be extended for 0 days.

(21) Appl. No.: 09/319,525

(22) PCT Filed: Dec. 5, 1997

(86) PCT No.: PCT/GB97/03266

§ 371 Date: Aug. 2, 1999

§ 102(e) Date: Aug. 2, 1999

(87) PCT Pub. No.: WO98/24708

PCT Pub. Date: Jun. 11, 1998

(30) Foreign Application Priority Data

Dec. 6, 1996 (GB) ..... 9625420

(51) Int. Cl.[7] ..... A47F 5/11

(52) U.S. Cl. ..... 211/132.1; 211/126.16; 248/174

(58) Field of Search ..... 211/132.1, 126.16; 248/174

(56) References Cited

U.S. PATENT DOCUMENTS 2,135,093 * 11/1938 Abrams ..... 248/174 X
4,191,288 * 3/1980 Hostad ..... 206/45.22
5,692,714 * 12/1997 Morrison ..... 211/132.1 X

* cited by examiner

*Primary Examiner*—Daniel P. Stodola
*Assistant Examiner*—Erica B. Harris
(74) *Attorney, Agent, or Firm*—Kilpatrick Stockton LLP

(57) ABSTRACT

A carton box retainer for a plurality of carton boxes each having opposed ends. The retainer includes a retention member having a plurality of pairs of connection elements spaced along the retention member, each pair of connection elements being connectable to the opposed ends of a carton box for attaching the carton box to the retention member. The connection elements are detachably secured to the carton box and/or the remainder of the retention member in order to enable the carton boxes to be separated from the retainer.

8 Claims, 5 Drawing Sheets

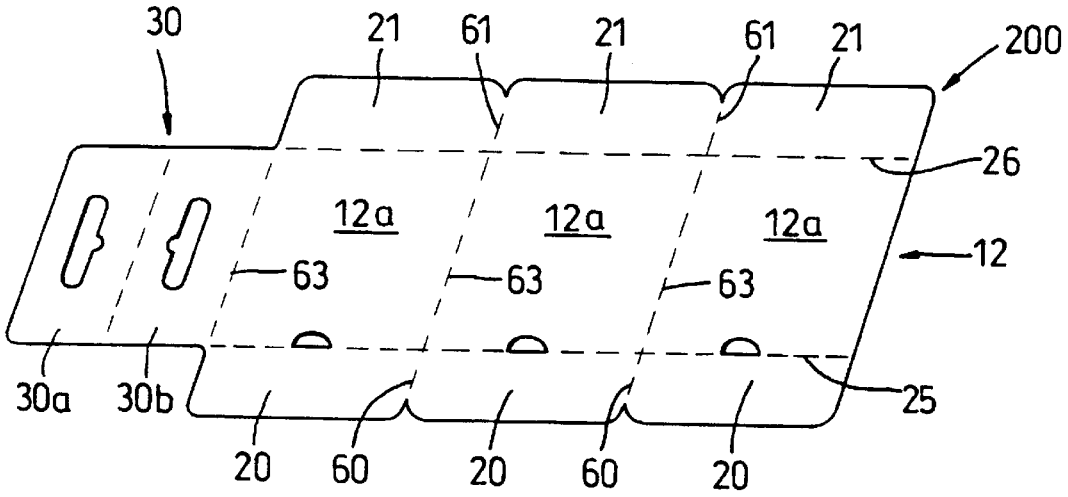
*Fig. 8*
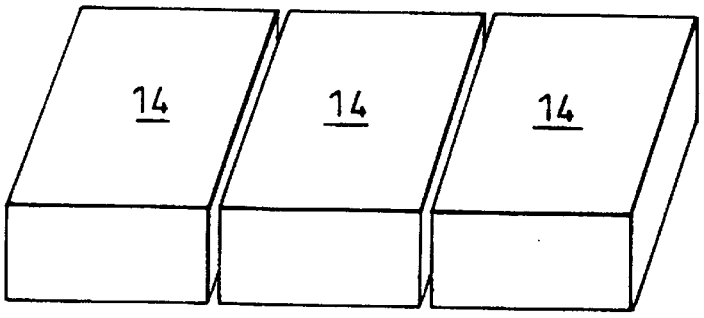
*Fig. 9*
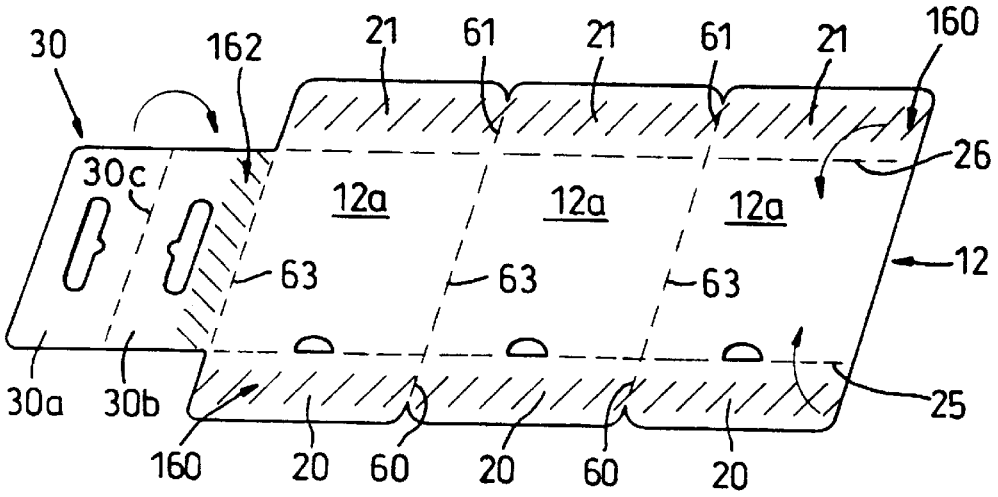

CARTON BOX RETAINER

The present invention relates to a carton box retainer adapted to retain, in a detectable manner, a plurality of individual carton boxes.

The invention also relates to a pack assembly comprising a plurality of carton boxes retained together by said retainer.

The invention also relates to a process for producing said pack assembly.

Products for retail sale are commonly supplied in carton boxes to retailers. The carton boxes tend to be supplied loose to the retailer in large transit boxes containing many carton boxes. The carton boxes may be loosely retained in the transit box or may be stored loosely in set numbers within display boxes. The retailer will normally display the carton boxes either in the display boxes or will stack individual carton boxes on a shelf or counter. In the former case, the provision of a display box is relatively expensive; in the latter case stacking the carton boxes is time consuming and requires constant attention in order to keep the stack in order.

It is a general aim of the present invention to provide a carton box retainer which enables a plurality of carton boxes to be retained together in a detachable manner without incurring the cost of providing a display box. According to one aspect of the present invention there is provided a carton box retainer for a plurality of carton boxes each having opposed ends, the retainer including a retention member having a plurality of pairs of connection means spaced along the retention member, each pair of connection means being adapted for connection to said opposed ends of a carton box for attaching the carton box to the retention member, the connection means being detachably secured to the carton box and/or the remainder of the retention member in order to enable the carton box to be separated from the retainer.

Various aspects of the present invention are hereinafter described with reference to the accompanying drawings, in which:

FIG. 8 is a perspective view of a blank for forming the retainer of the pack assembly illustrated in FIG. 4;

FIG. 9 is a view similar to FIG. 8 diagrammatically illustrating assembly of the pack assembly.

Figure 1:
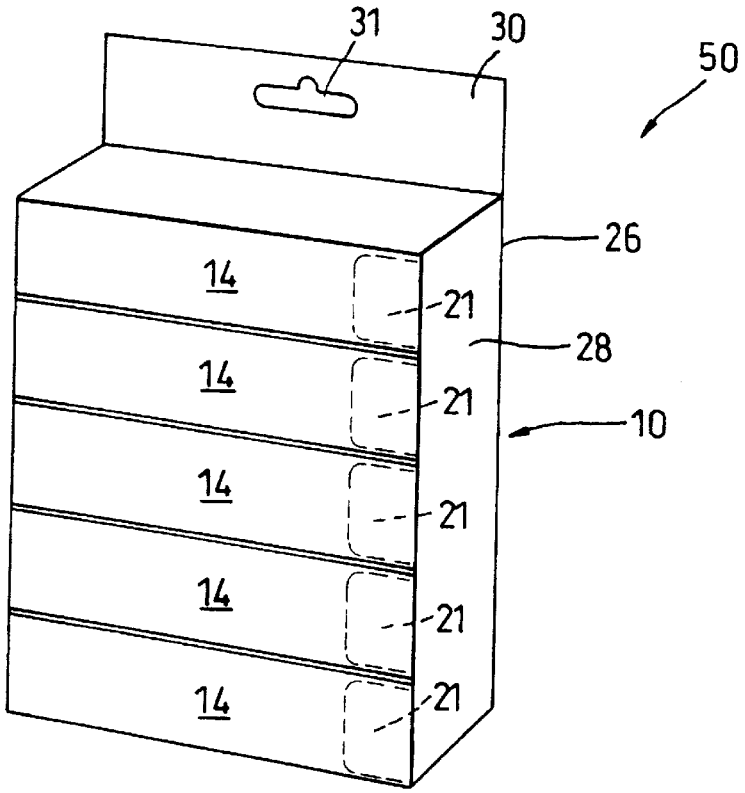
FIG. 1 is a perspective view of a pack assembly according to a first embodiment of the present invention having a retainer supporting five carton boxes.
Figure 2:
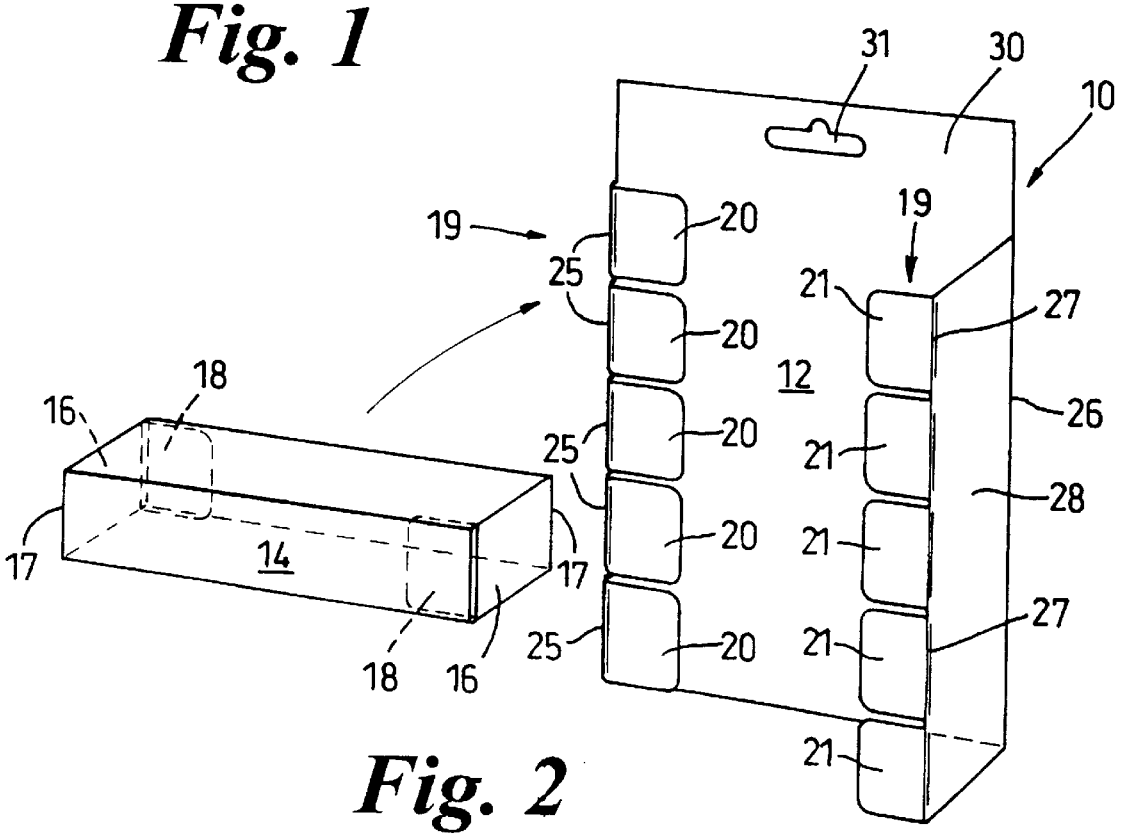
FIG. 2 is a perspective view similar to FIG. 1 showing the retainer carton prior to attachment of carton boxes.
Figure 3:
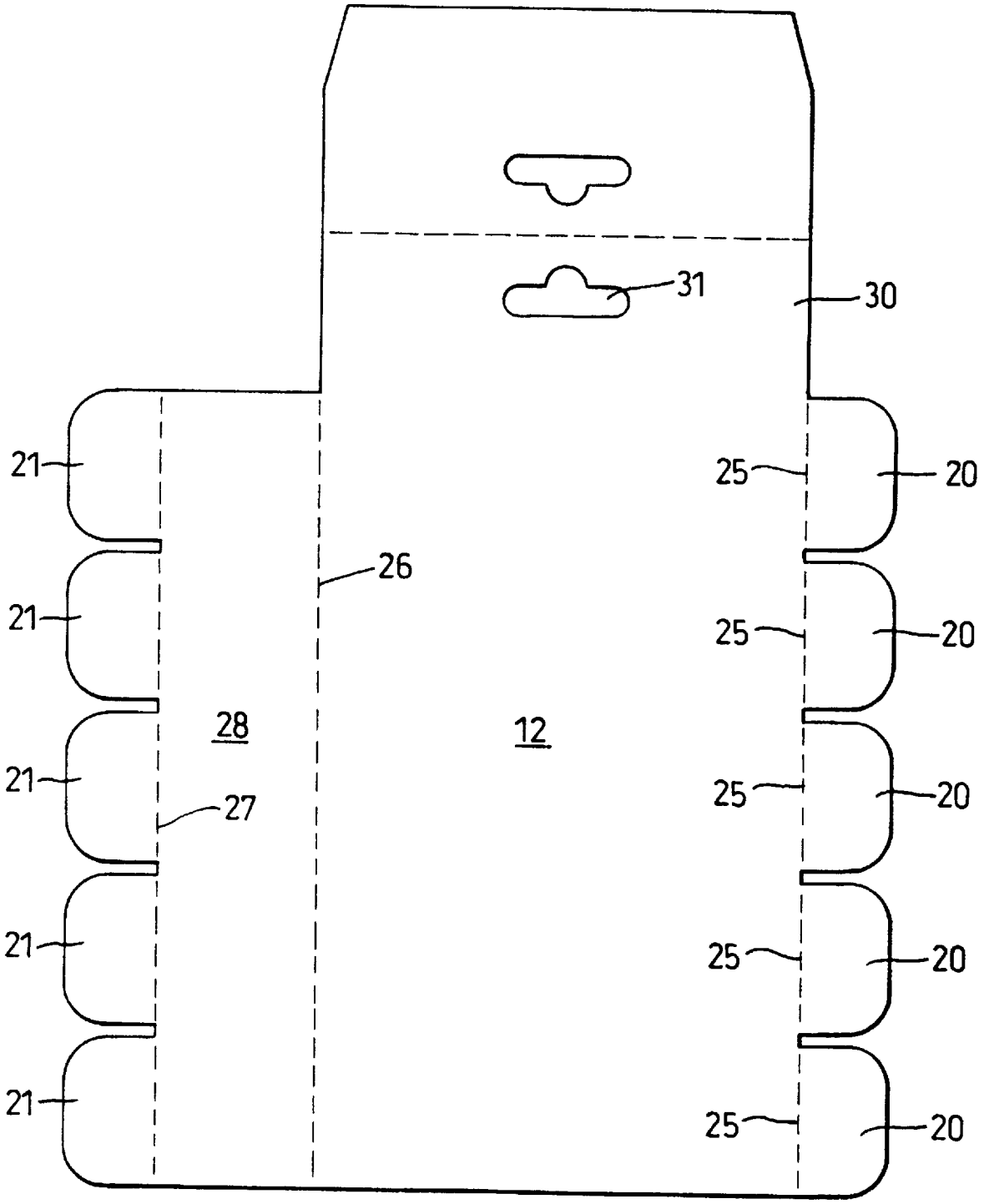
FIG. 3 is a plan view of a blank for forming the retainer of FIG. 1.
Figure 4:
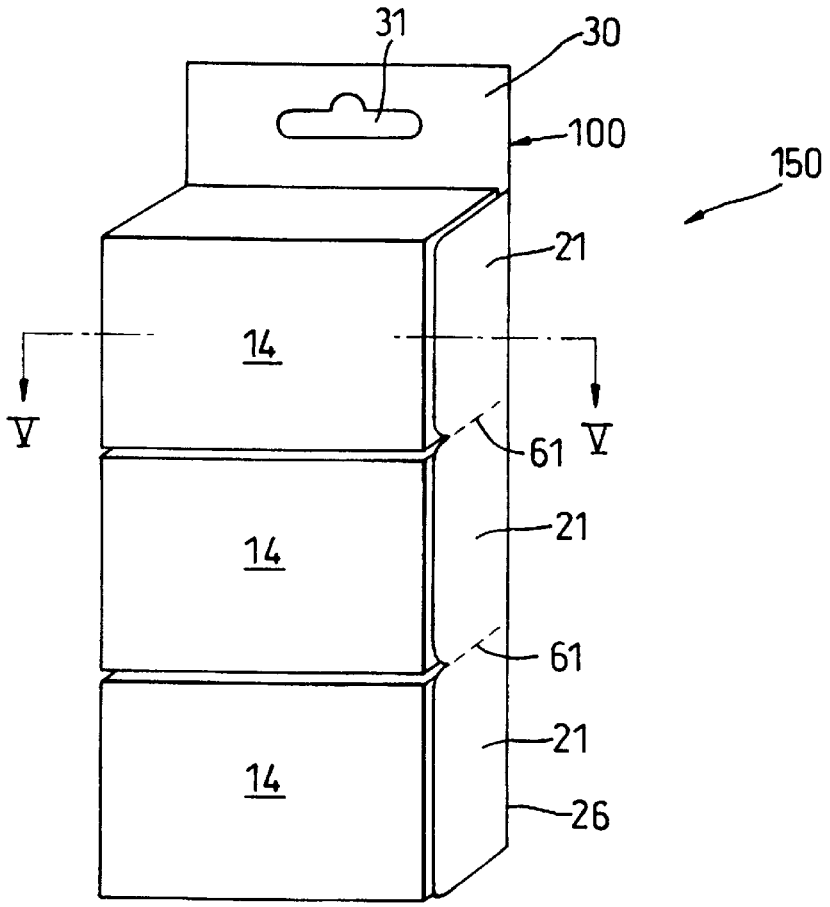
FIG. 4 is a schematic perspective view of a pack assembly according to a second embodiment of the present invention.
Figure 5:
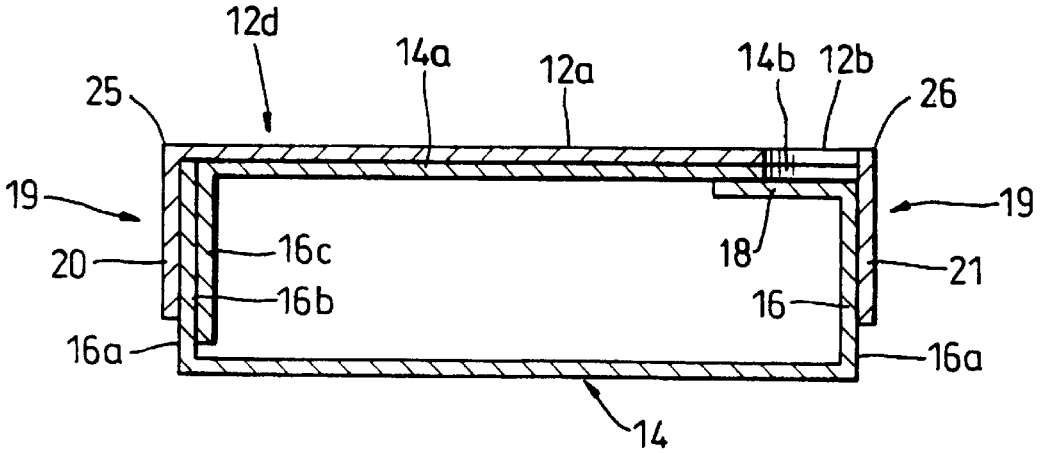
FIG. 5 is a sectional view taken along line V—V in FIG. 4.

A pack assembly 50 according to a first embodiment of the present invention is illustrated in FIGS. 1 to 3 and comprises a retainer 10 to which a plurality of carton boxes 14 are attached.

Each carton box 14 has a closure lid 16 at each end which is hingedly connected to the box 14 via a fold 17. The lid 16 is provided with a tongue 18 at its side opposite the fold 17; the tongue being inserted into the interior of the box.

The retainer 10 includes a retention member 12 which provides common support for all the carton boxes 14 and so retains the integrity of the assembly 50.

Attachment of each carton box 14 to the retention member is achieved using opposed pairs of connection means 19, which in the first embodiment, preferably comprise opposed tongues 20, 21.

The tongues 20, 21 are adapted to be inserted into opposed ends of a box 14 in between the lid tongue 18 and opposed side wall of the box 14.

As seen in the drawings, the lid 16 at one end of a box 14 is attached to one side wall of the box and the lid 16 at the opposite end is attached to the opposite side wall.

Accordingly, in order to correctly position the tongues 20, 21 for insertion into the boxes 14, tongues 20 are hingedly connected to the retention member 12 by a single fold 25 and tongues 21 are hingedly connected to the retention member 12 by a spacing member 28 which is located between a pair of spaced folds 26, 27.

Conveniently, as shown, a single continuous spacing member 28 is located between folds 26, 27 so as to extend in a continuous manner along one side of the retention member.

It is envisaged however that individual spacing members 28 for each tongue 21 may be provided, the individual spacing members being spaced along the side of the retention member.

It is also envisaged that if boxes 14 have both lids 16 connected to the same side wall, then either tongues 21 may be hingedly connected to the retention member 12 by a single fold (in a similar manner to tongues 20) or tongues 20 may be hingedly connected to the retention member 12 by a pair of spaced folds (in a similar manner to tongues 21).

Boxes 14 may be removed from the retainer 10 individually by retracting one or both of the tongues 20, 21 by which the box is connected to the retainer.

It is also envisaged that one or both of the tongues 20, 21 may be detachably secured to the retention member 12, for example by tear lines, to facilitate removal of each box from the retainer. For example, lines of perforations may be provided along folds 25, 26 and/or 27 to define tear lines along one or more of said folds.

A pack assembly 150 according to a second embodiment of the invention is illustrated in FIGS. 4 to 7 and comprises a retainer 100 to which 3 carton boxes are attached. In the second embodiment, parts similar to those in the first embodiment 10 have been designated with the same reference numerals.

In the second embodiment 100, the pairs of connection means 19 are adapted for securing in face to face contact with end faces 16*a* of the opposed ends of the carton box 14. Preferably both connection means 19 of each pair comprise opposed tongues 20, 21 which are connected to the retention member 12 by single folds 25, 26. Preferably each fold line 25, 26 is adapted to define a tear line. Preferably adjacent tongues 20 and adjacent tongues 21 are joined together by tear lines 60, 61 respectively. In addition, there is preferably provided a tear line 63 (FIG. 8) extending across the retention member 12 from opposed tear lines 60, 61, the tear lines 63 defining portions 12*a* of the retention member. Preferably all tear lines 25, 26, 60, 61 and 63 are defined by a line of perforations.

Each carton box 14 is preferably secured in face to face contact with opposed tongues 20, 21 by a suitable adhesive, such as a hot melt adhesive.

Preferably the box 14 is not bonded in face to face contact with the retention member 12 such that each carton box 14 is solely connected to the retention member 12 via the connection means 19.

Figure 6:
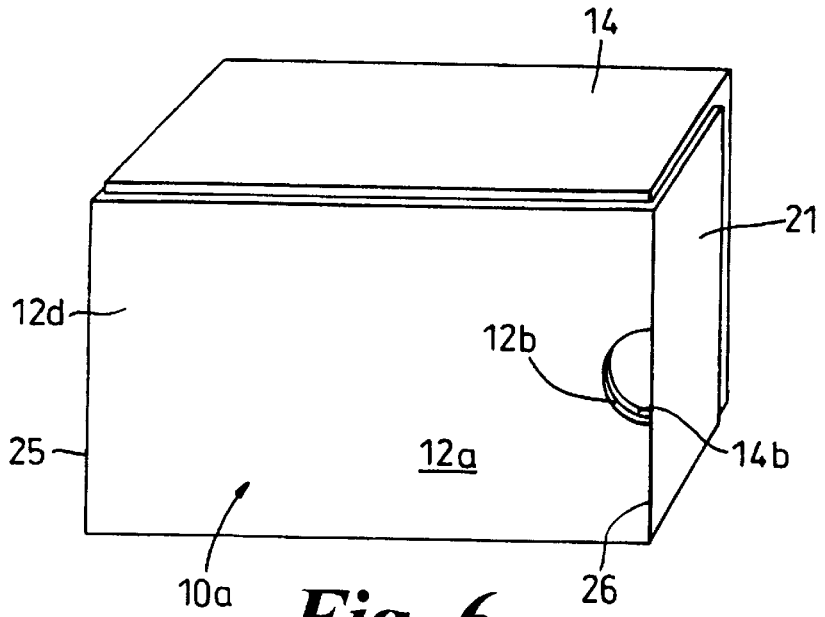
FIG. 6 is a perspective view of a carton box and portion of the retainer after detachment from the pack assembly.

In use, the lowermost carton box 14 is removed by hinging it about the lowermost tear line 63 in order to cause the opposed tear lines 60, 61 to tear. The lower carton box 14 may then be removed from the remainder of the retention member 12 by tearing along the tear line 63. Accordingly, the removed carton box 14 has attached to it a lower portion of the retainer 10*a* comprising a pair of tongues 20, 21 and the lower portion 12*a* of the retention member 12 connected therebetween: this is illustrated in FIG. 6.

Figure 7:
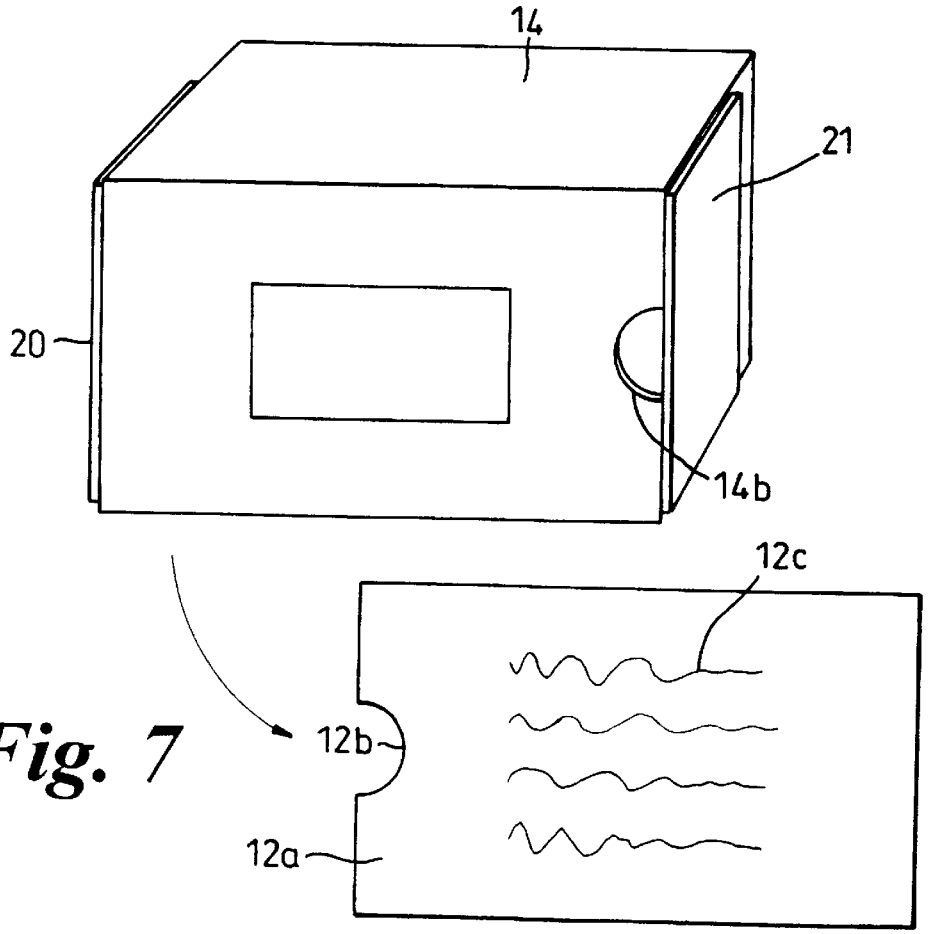
FIG. 7 is a perspective view illustrating removal of the retention member portion from the carton box of FIG. 6.

The lower portion 12*a* is subsequently removed by tearing along tear lines 25, 26 to leave the tongues 20, 21 still attached to the end faces of the carton box 14. This is schematically illustrated in FIG. 7.

This arrangement may be used to advantage for marketing purposes. For example, information 12*c* may be printed on the inside face of each of the body portions 12*a* and this information will be hidden from view until the body portion 12*a* is removed as indicated in FIG. 7. Thus this information will remain secret until body portion 12*c* is removed.

This arrangement therefore enables the retention member portion 12*a* to serve as a voucher which is only redeemable after removal or enables competition information to be printed on the inside face of the body portions 12*a* so that pre-selected body portions 12*a* carry indicia which indicates the winning of a prize which is only discovered after removal.

Alternatively, other information useful to the contents of the carton box may be printed on the inside face of the body portion 12*a*. The same information may be printed on each body portion 12*a* in cases where all the carton boxes have the same contents or different information, may be printed on each body portion 12*a*, the information being specific to the contents of the box to which the body portion 12*a* is attached.

By the provision of opposed pairs of tongues 20, 21 which are bonded in face to face contact with the opposed ends of the box 14, it is possible for one end of the carton box 14 to be permanently closed, eg. by the provision of overlying flaps 16*b*, 16*c* which are bonded to one another.

The bonding of tongues 21 to the hinged closure lid 16 of the carton box 14 has the advantage of ensuring that the lid 16 is sealed, ie. access into the carton box 14 cannot be gained until the fold line 26 is torn. This provides a tamper evident feature and is applicable to box 14 without requiring any modification to the box 14. Also the tamper evident feature is present after the lower carton box 14 and retainer portion 10*a* have been removed from the assembly.

Advantageously, the rear wall 14*a* of the carton box 14 is provided with a thumb recess 14*b* adjacent to the lid 16 which exposes an upper portion of the flap 18 for facilitating opening of the lid 16. When such a recess 14*b* is provided, the retention member 12 is preferably provided with correspondingly shaped apertures 12*b* which overlie recesses 14*b* and so facilitate opening of the lid 16 by tearing of fold line 26.

Joining of adjacent tongues 20 and adjacent tongues 21 is preferred. This has the advantage of rigidifying the retention member 12 and helps to simplify the assembly process.

However, it will be appreciated that adjacent tongues 20, 21 may be separate as for example illustrated in the first embodiment 10.

Preferably the retainer 10, 100 for both embodiments is formed in one piece from a suitable sheet material such as card or plastics sheet such that the retention member 12 and tongues 20, 21 are integrally connected.

In both embodiments, retention member 12 is preferably adapted for hanging by the provision of an extended portion 30 having a suspension aperture 31. However, it will be appreciated that retention member 12 may be adapted for hanging in other ways, such as for example by the provision of a separate suspension hook which may be attached to the extended portion or directly to the retention member 12 should the extended portion be omitted.

It will be appreciated that the retainer of the present invention uses substantially less card than a conventional display box and is also simpler to produce. Accordingly it is more cost effective than a conventional display box.

In addition, the retainer of the present invention has other advantages over a conventional display box. For example, the retainer positively holds a plurality of boxes 14 together, i.e., they are not loosely retained as in a display box. This means that set of boxes 14 is more convenient to handle both by the retailer and purchaser.

In the first embodiment, five boxes 14 are shown attached to the retainer 10 and in the second embodiment three boxes 14 are shown attached to retainer 100. It will be appreciated that the number of boxes 14 in these embodiments are given by way of example and that the present invention applies to a pack assembly containing two or more boxes 14.

A process for assembling a pack assembly 150 according to the second embodiment of the present invention is schematically illustrated in FIGS. 8 and 9.

In FIG. 8 and 9, a blank 200 for forming the retainer 100 is illustrated. In order to assemble a pack assembly 150, lines of hot melt adhesive 160 (FIG. 9) are applied along the inner face of connected tongues 20 and 21.

Selected carton boxes 14 are then placed upon the retention member 12 and the tongues 20 and 21 are folded about fold lines 25, 26 to bring the inner faces of the tongues 20, 21 into contact with the opposed end faces of the boxes 14.

If the extended portion 30 is provided, this is preferably formed by two layers of card which are folded and held in contact by a line of hot melt 162. This is achieved by providing two portions 30*a*, 30*b* and applying the hot melt adhesive 162 to one or both of these portions and folding about fold line 30*c* prior to placing the carton boxes 14 onto the retention member 12.

The above process may be conducted on automatic machinery or may be manually performed.

When forming the blank 200, the distance between the fold lines 25, 26 is chosen to be substantially equal to the distance between the opposed ends of the carton boxes 14 and the distance between adjacent tear lines 63 is chosen to be substantially equal to the width of the boxes 14.

It is envisaged that the boxes 14 arranged in the pack assembly may have the same or different contents.

It is to be appreciated that the carton boxes 14 used within the pack assembly do not have to be specially adapted for connection to the retainer 100 and so can be used without mounting on the retainer.

It is envisaged that when displaying the pack assembly according to the present invention, the outer face 12*d* of the retention member 12 will be located at the front so as to be visible to a purchaser at the point of sale. This retention member therefore has the advantage of offering a large flat printing area which can be used to display high impact graphics and/or information.

What is claimed is:

1. A pack assembly including a carton box retainer to which a plurality of carton boxes are attached, each of said boxes having opposed ends, the retainer including a retention member having a plurality of pairs of connection means spaced along the retention member, each carton box being attached to the retention member by a pair of connection means which are only secured in face to face contact with end faces of the carton box, said connection means of said retention member for attaching the carton box to the retention member being divided by a tear line positioned between adjacent pairs of connection means to thereby enable a portion of the retention member carrying a carton box to be removed from the remainder of the retention member, each pair of connection means being detachably secured to the retention member portion in order to enable said portion of the retention member to be separated from the carton box.

2. A pack assembly according to claim 1 wherein one of the ends of each box is defined by a hinged closure lid to which a first connection means of an associated pair of connection means is secured, said first connection means while attached to said portion of the retention member cooperating to prevent opening of said closure lid.

3. A pack assembly according to claim 1 wherein an inside face of said portion of the retention member carries information which is only revealed on detachment of said portion from one or both of the connection means of said pair of connection means.

4. A retainer according to claim 1 wherein the retention member comprises a planar body, the pairs of connection means being spaced along opposite sides of the body.

5. A pack assembly according to claim 4 wherein adjacent connection means on the same side of the retention member are joined by tear lines.

6. A retainer according to claim 1 wherein each of the pairs of connection means for each carton box comprises a pair of tongues secured to said end faces of said opposed ends of the carton box by bonding.

7. A pack assembly according to claim 6 wherein each pair of tongues is detachably secured to the retention member by a tear line.

8. A process for producing a pack assembly according to claim 1, the process including forming said retainer so as to have a retention member comprising a planar body and pairs of connection means comprising tongues spaced along opposite sides of the body, applying adhesive onto said tongues only, placing carton boxes into contact with said planar body, and folding said tongues toward and into face contact with said opposed ends of the carton boxes to secure the tongues to said opposed ends.

* * * * *